US006918968B2

(12) United States Patent
Semba et al.

(10) Patent No.: US 6,918,968 B2
(45) Date of Patent: Jul. 19, 2005

(54) AUSTENITIC STAINLESS STEEL

(75) Inventors: Hiroyuki Semba, Sanda (JP); Masaaki Igarashi, Sanda (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 10/829,274

(22) Filed: Apr. 22, 2004

(65) Prior Publication Data

US 2004/0234408 A1 Nov. 25, 2004

(30) Foreign Application Priority Data

Apr. 25, 2003 (JP) ..... 2003-122494

(51) Int. Cl.[7] ..... C22C 38/42

(52) U.S. Cl. ..... 148/327; 148/428; 420/43; 420/44; 420/45; 420/46; 420/47; 420/48

(58) Field of Search ..... 148/325, 327, 148/428; 420/43, 44, 45, 46, 47, 48

(56) References Cited

U.S. PATENT DOCUMENTS

| | | | |
|---|---|---|---|
| 4,742,324 | A | 5/1988 | Shida et al. |
| 4,842,823 | A | 6/1989 | Sawaragi et al. |
| 5,378,427 | A | 1/1995 | Otsuka et al. |
| 6,485,679 | B1 | 11/2002 | Sundstrom et al. |

FOREIGN PATENT DOCUMENTS

| | | | |
|---|---|---|---|
| EP | 0690141 | A1 | 1/1996 |
| EP | 0780483 | A1 | 6/1997 |
| JP | 61183452 | * | 8/1985 |
| JP | 63309392 | | 12/1988 |
| JP | 01287249 | * | 11/1989 |
| JP | 07-138708 | | 5/1995 |
| JP | 08-013102 | | 1/1996 |
| JP | 8-30247 | | 3/1996 |
| JP | 09-195005 | | 7/1997 |
| JP | 2000-073145 | | 3/2000 |
| JP | 2000-328198 | | 11/2000 |
| JP | 2001-049400 | | 2/2001 |
| JP | 2001107196 | * | 4/2001 |
| JP | 2002212634 | | 7/2002 |

* cited by examiner

*Primary Examiner*—Sikyin Ip
(74) *Attorney, Agent, or Firm*—Clark & Brody

(57) ABSTRACT

An austenitic stainless steel excellent in high temperature strength, high temperature ductility and hot workability, consisting of, by mass %, C: more than 0.05% to 0.15%, Si: 2% or less, Mn: 0.1 to 3%, P: 0.04% or less, S: 0.01% or less, Cr: more than 20% to less than 28%, Ni: more than 15% to 55%, Cu: more than 2% to 6%, Nb: 0.1 to 0.8%, V: 0.02 to 1.5%, sol. Al: 0.001 to 0.1%, but sol.Al$\leqq$0.4×N, N: more than 0.05% to 0.3% and O (Oxygen): 0.006% or less, but O$\leqq$1/(60×Cu), and the balance Fe and impurities. The austenitic stainless steel may contain at least one of Co, Mo, W, Ti, B, Zr, Hf, Ta, Re, Ir, Pd, Pt and Ag, and/or at least one of Mg, Ca, Y, La, Ce, Nd and Sc.

8 Claims, No Drawings

AUSTENITIC STAINLESS STEEL

FIELD OF THE INVENTION

The present invention relates to an austenitic stainless steel, which is used as heat-resistant and pressure-resistant members, such as tubes, plates, bars, and forged parts for power generating boilers, chemical plants and the like. The invention relates specifically to an austenitic stainless steel, excellent in creep strength, creep rupture ductility and hot workability.

BACKGROUND OF THE INVENTION

As materials of devices, which are used for boilers, chemical plants and the like, under a high temperature environment, 18-8 austenitic stainless steels such as SUS304H, SUS316H, SUS321H and SUS347H, have been used. In recent years the use conditions of these devices under such a high temperature environment, have become remarkably severe. Accordingly the required properties for the materials used in such an environment have attained a higher level. The conventional 18-8 austenitic stainless steels are insufficient in high temperature strength, particularly in creep strength, so in these circumstances, an austenitic stainless steel, having improved high temperature strength by adding the particular amounts of various elements, has been proposed.

For example, an austenitic stainless steel in which high temperature strength was significantly improved by adding the comparatively inexpensive Cu together with Nb and N in proper amounts, has been proposed in Publication of examined Patent Application No. Hei 8-30247, Publication of unexamined Patent, Application No. Hei 7-138708 and Publication of unexamined Patent Application No. Hei 8-13102. In this steel Cu precipitates coherently with the austenite matrix during use at high temperatures, and Nb precipitates as complex nitiride with Cr, NbCrN. Since these precipitates very effectively act as barriers against the dislocation movement, the high temperature strength of the austenitic stainless steel is enhanced.

However, in the field of the thermal power generation boiler, a project which increases the vapor temperature to between 650° C. and 700° C., wherein the temperature of the material for parts far exceeds 700° C., has been recently promoted. Therefore, the austenitic stainless steels proposed in the above-mentioned Patent Documents will be insufficient in various properties. In other words the above-mentioned Cu, Nb and N added steels, as materials for being able to endure in the said environment of high temperature and high pressure, are still insufficient in high temperature strength and corrosion resistance. Particularly, there is also another problem, which is the toughness of the steel, after being used at high temperatures of 800° C. or higher for long period, is insufficient. Further, the hot workability of the Cu, Nb and N added steels is inferior to that of the conventional 18-8 austenitic stainless steel, therefore an prompt improvement of the steels is required.

Some steels, in which hot workability has been improved to some extent, have been proposed. For example, in Publication of unexamined Patent Application No. Hei 9-195005, a steel in which the hot workability is enhanced by adding one or more of Mg, Y, La, Ce and Nd, has been proposed. In Publication of unexamined Patent Application No. 2000-73145 and Publication of unexamined Patent Application No. 2000-328198 steels in which the hot workability is enhanced by adding proper amounts of Mn, Mg, Ca, Y, La, Ce or Nd, in accordance with the amounts of Cu and S, have been proposed. Further, in Publication of unexamined Patent Application No. 2001-49400, a steel in which the tube making properties, in a hot rolling method such as the Mannesmann mandrel mill process, are improved by adding B (Boron), under limitation of S to 0.001% or less, and O (Oxygen) to 0.005% or less, and further adding Mg or Ca in proper amounts, in accordance with the amounts of S and O has been proposed.

However, these steels are insufficient in the improvement of hot workability. Particularly, the workability at temperatures of 1200° C. or higher has not been improved.

Generally, a material having poor hot workability is formed into a seamless tube by hot extrusion. Since the internal temperature of the material becomes higher than the heating temperature, due to the heat produced by working, material having insufficient workability at 1200° C. or higher generates cracks, so-called lamination, and inner defects. This phenomenon is the same as in a piercing by the piercer in the Mannesmann mandrel mill process and the like.

SUMMARY OF THE INVENTION

The present invention has been invented for solving the above-mentioned problems. The objective of the present invention is to provide an austenitic stainless steel in which the creep strength and creep rupture ductility are improved, and the hot workability, particularly the high temperature ductility at 1200° C. or higher, is significantly improved.

The inventors have studied in order to attain the above-mentioned objective and found the following.

(a) In order to increase the creep strength, it is effective to use an austenitic stainless steel, in which Cu, Nb and N are added together, for the base material.

(b) For a significant improvement of the creep rupture ductility and hot workability, particularly the high temperature ductility at 1200° C. or higher, it is effective to control P and O properly, in accordance with the Cu content.

(c) It is effective to control the Al content, in accordance with the N content, for the improvement of creep strength.

(d) Addition of V to the steel is effective in not only the improvement of creep strength but also in the improvement of toughness, after the steel is used at a high temperature, particularly at 800° C. or higher, for long period.

The present invention has been completed based on the above-mentioned findings, and the gist of the present invention is the following austenitic stainless steels.

An austenitic stainless steel characterized by consisting of, by mass %, C: more than 0.05% to 0.15%, Si: 2% or less, Mn: 0.1 to 3%, P: 0.04% or less, S: 0.01% or less, Cr: more than 20% to less than 28%, Ni: more than 15% to 55%, Cu: more than 2% to 6%, Nb: 0.1 to 0.8%, V: 0.02 to 1.5%, sol. Al: 0.001 to 0.1%, N: more than 0.05% to 0.3% and O (Oxygen): 0.006% or less, and the balance Fe and impurities, further characterized by satisfying the following formulas (1) and (2). Wherein each element symbol in the formulas (1) and (2) represents the content (mass %) of each element:

$$P \leqq 1/(11 \times Cu) \quad (1)$$

$$sol.Al \leqq 0.4 \times N \quad (2)$$

The above-mentioned austenitic stainless steel may contain, instead of a part of Fe, at least one element selected from the first element group consisting of Co: 0.05 to 5%, Mo: 0.05 to 5%, W: 0.05 to 10%, Ti: 0.002 to 0.2%, B: 0.0005 to 0.05%, Zr: 0.0005 to 0.2%, Hf: 0.0005 to 1%, Ta: 0.01 to 8%, Re: 0.01 to 8%, Ir: 0.01 to 5%, Pd: 0.01 to 5%, Pt: 0.01 to 5% and Ag: 0.01 to 5%, and/or at least one element selected from the second element group consisting of Mg: 0.0005 to 0.05%, Ca: 0.0005 to 0.05%, Y: 0.0005 to 0.5%, La: 0.0005 to 0.5%, Ce: 0.0005 to 0.5%, Nd: 0.0005 to 0.5% and Sc: 0.0005 to 0.5%. When Mo and W are contained, the following formula (3) should be satisfied.

$$Mo+(W/2)\leqq 5 \quad (3)$$

It is preferable that the steel according to the present invention satisfies the following formula (4).

$$O\leqq 1/(60\times Cu) \quad (4)$$

BEST MODE FOR CARRYING OUT THE INVENTION

In the following, the explanation of the restrictions of the chemical composition of the austenitic stainless steel of the present invention will be presented. Hereinafter, "%" for contents of the respective elements means "% by mass".

1. Chemical Composition of the Steel According to the Present Invention

C: more than 0.05% to 0.15%

C (Carbon) is an effective and important alloying element. It is necessary for ensuring tensile strength and creep strength that are required when the steel is used in a high temperature environment. When the carbon content is 0.05% or less, these effects are not sufficient. On the other hand, when the carbon exceeds 0.15%, an amount of unsolved carbide in the solution-treated state increases. The unsolved carbide does not contribute to the improvement of the high temperature strength. Additionally, the excessive amount of carbon deteriorates the mechanical properties such as toughness and weldability. Thus, the C content is set at more than 0.05% but not more than 0.15%. The C content is more preferably 0.13% or less, and most preferably 0.11% or less.

Si: 2% or less

Si (Silicon) is added as a deoxidizer, and is an effective element to enhance oxidation resistance, steam oxidation resistance and the like of the steel. Si, exceeding 2%, promotes the precipitation of intermetallic compounds such as a phase and also the precipitation of a large amount of nitride, and further deteriorates the stability of the structure at high temperatures. Thus the toughness and ductility of the steel are decreased. Further, the weldability and hot workability are also reduced. Accordingly, the Si content is set at 2% or less. When the toughness and ductility are particularly important, the Si content is preferably 1% or less, and more preferably 0.5% or less. When deoxidation is ensured sufficiently by other elements, Si is not necessarily added. However, if the deoxidation of the steel, oxidation resistance, or steam oxidation resistance and the like are essential, the Si content is preferably 0.05% or more. The most preferable Si content is 0.1% or more.

Mn: 0.1 to 3%

Mn (Manganese), likewise to Si, has a deoxidizing effect of the molten steel, and fixes S, which is inevitably contained in the steel, as a sulfide to improve hot workability. Mn content of 0.1% or more is needed in order to obtain these effects sufficiently. However, if the Mn content exceeds 3%, the precipitation of intermetallic compound phases such as a phase is promoted so that the stability of structure, high temperature strength and mechanical strength of the steel are deteriorated. Thus, the Mn content is set at 0.1 to 3%. A more preferable Mn content is 0.2 to 2%, and the most preferable Mn content is 0.2 to 1.5%.

P: 0.04% or less

P (Phosphorus) is an impurity which is inevitably contained in the steel and remarkably decreases the hot workability. Thus, the P content is limited to 0.04% or less. Since P decreases creep rupture ductility, particularly the high temperature ductility at 1200° C. or higher, and the hot workability, due to an interaction with Cu, it is necessary that the P content should be in a range satisfying the following formula (1) in relation to the Cu content.

$$P\leqq 1/(11\times Cu) \quad (1)$$

S: 0.01% or less

Although S (Sulfur) is an impurity, which remarkably decreases the hot workability like P, it is an effective element to enhance machinability and weldability. From the viewpoint of preventing the decrease in hot workability it is desirable that the S content be as little as possible. In the steel, according to the present invention, the hot workability is improved by controlling the P content or the O (Oxygen) content properly in accordance with Cu content. Therefore the S content of up to 0.01% is allowable. Particularly, in a case where the hot workability is very important, the S content should desirably be 0.005% or less, and even more desirably at 0.003% or less.

Cr: more than 20% to less than 28%

Cr (Chromium) is an important alloying element, which ensures oxidation resistance, steam oxidation resistance, high temperature corrosion resistance and the like. Cr is also an element that forms Cr carbonitride and increases strength. Since, the conventional 18-8 austenitic stainless steel is insufficient in order to exert corrosion resistance and high temperature strength, which is needed under the high temperature environment of 650 to 700° C. or higher, the steel of the present invention needs the addition of more than 20% Cr. The more the Cr content, the more corrosion resistance improves. However, a Cr content of 28% or more makes the austenite structure unstable and facilitates the generation of intermetallic compounds such as the σ phase and an the α—Cr phase, which reduce the toughness and the high temperature strength of the steel. Accordingly, the Cr content is set at more than 20% to less than 28%.

Ni: more than 15% to 55%

Ni (Nickel) is an indispensable alloying element, which ensures the stable austenite structure. The most suitable Ni content is determined by the contents of the ferrite stabilizing elements such as Cr, Mo, W and Nb, and the austenite stabilizing elements such as C and N. As mentioned above, in the steel according to the present invention, more than 20% Cr must be contained. If the Ni content is 15% or less with respect to this Cr content, it is difficult to make the structure of the steel the single phase of austenite. Further, in this case, an austenite structure becomes unstable during a long period of use, whereby brittle phases such as σ phase precipitate. The high temperature strength and the toughness of the steel remarkably deteriorate due to these brittle phases, and the steel cannot endure as a heat-resistant and pressure resistant material. On the other hand, if Ni content exceeds 55%, the effects are saturated and the production cost increases. Thus, the Ni content is set at more than 15% to 55%.

Cu: more than 2% to 6%

Cu (Copper) is one of the most important and distinctive elements because it precipitates coherently with the austenite matrix as Cu-phase, during the use at high temperatures, and it significantly enhances creep strength of the steel. In order to exert the effects, a Cu content of more than 2% is necessary. However, if Cu content exceeds 6%, not only the enhancement effect of its creep strength saturates but also the creep rupture ductility and hot workability of the steel decrease. Thus, the Cu content is set from more than 2% to 6%. A preferable range of the Cu content is 2.5 to 4%.

Nb: 0.1 to 0.8%

Nb (Niobium) is an important element, similar to Cu and N. Nb forms fine carbonitride such as NbCrN, and enhances creep rupture strength and also suppresses grain-coarsening during the solution heat treatment after the final working. Thereby Nb contributes to the improvement of creep rupture ductility. However, if the Nb content is less than 0.1%, sufficient effects cannot be obtained. On the other hand, when the Nb content exceeds 0.8%, in addition to the deterioration of weldability and mechanical properties due to an increase in the unsolved nitride, hot workability, and also particularly high temperature ductility at 1200° C. or higher, is remarkably decreased. Thus, the Nb content is set at 0.1 to 0.8%. A preferable range of the Nb content is 0.2 to 0.6%.

V: 0.02 to 1.5%

V (Vanadium) forms carbonitrides such as (Nb,V)CrN, V(C,N), and is known as an effective alloying element for enhancing high temperature strength and creep strength. However, according to the present invention, V is added for enhancing the high temperature strength and toughness during long period of use at high temperatures, particularly at 800° C. or higher. In the steel containing Cu, according to this invention, the high temperature and toughness enhancement effects of V is based on the fact that V contributes to the promotion of precipitation of fine Cu-phase, the suppression of grain coarsening and the suppression of coarsening of $M_{23}C_6$, on grain boundaries. Further V precipitates as V(C,N) thereby increases the rate of grain boundary decoration by precipitates. However, if V content is less than 0.02%, the above-mentioned effects cannot be obtained, and if the V content exceeds 1.5%, the high temperature corrosion resistance, ductility and toughness are deteriorated due to precipitation of a brittle phase. Thus the V content is set at 0.02 to 1.5%. A preferable range of the V content is 0.04 to 1%.

Sol. Al: 0.001 to 0.1%

Sol. Al (acid soluble Aluminum) is an element added as a deoxidizer in molten steel. It is important that its content must be severely controlled in accordance with the N content in the steel of the present invention. Sol.Al content of 0.001% or more is necessary in order to obtain the effects. However, if the sol.Al content exceeds 0.1%, the precipitation of intermetallic compounds such as the σ phase is promoted during the use at high temperatures and thereby decreasing toughness, ductility and high temperature strength. Thus, the sol.Al content is set at 0.001 to 0.1%. A preferable range of the sol.Al content is 0.005 to 0.05%, and the most desirable range is 0.01 to 0.03%.

Further, content of sol.Al must be controlled so as to satisfy the following formula (2) in accordance with the N content. Satisfying the formula (2) prevents N from being consumed uselessly as AlN, which does not contribute to high temperature strength, and, thereby, sufficient amount of precipitation of complex nitiride with Cr, (Nb,V)CrN, which is effective in enhancement of high temperature strength, can be obtained.

$$\text{sol.Al} \leqq 0.4 \times N \quad (2)$$

N: more than 0.05% to 0.3%

N (Nitrogen) is an effective alloying element, which ensures the stability of austenite in place of a part of expensive Ni. It is also effective in contributing to enhance tensile strength because it contributes to solid-solution strengthening as an interstitial solid solution element. Also N is an element, which forms fine nitrides such as NbCrN and these nitrides enhance creep strength and creep rupture ductility by suppressing grain coarsening. Therefore, N is one of indispensable and the most important elements similar to Cu and Nb. N content of more than 0.05% is necessary in order to exert these positive effects. However, even if the N content exceeds 0.3%, unsolved nitride increases and a large amount of nitride increases during use at high temperatures. Accordingly, ductility, toughness and weldability are impaired. Thus, the N content is limited in the range of more than 0.05% to 0.3%. A more preferable range is 0.06 to 0.27%.

O: 0.006% or less

O (Oxygen) is an element, which is incidentally contained in steel, and remarkably decreases hot workability. Particularly, in the steel containing Cu according to the present invention, creep rupture ductility and hot workability, especially high temperature ductility at 1200° C. or higher, are further decreased by mutual action of O and Cu. Thus, it is important to severely control the O content. Accordingly, it is necessary to limit the O content to 0.006% or less. Further, it is preferable that the content of O satisfies the following formula (4) in relation to the Cu content.

$$O \leqq 1/(60 \times Cu) \quad (4)$$

One of the austenitic stainless steels of the present invention is the steel, which contains the above-mentioned elements and the balance of Fe and impurities. Another austenitic stainless steel of the present invention is a steel containing, in place of a part of Fe, at least one element selected from the first group consisting of Co: 0.05 to 5%, Mo: 0.05 to 5%, W: 0.05 to 10%, Ti: 0.002 to 0.2%, B: 0.0005 to 0.05%, Zr: 0.0005 to 0.2%, Hf: 0.0005 to 1%, Ta: 0.01 to 8%, Re: 0.01 to 8%, Ir: 0.01 to 5%, Pd: 0.01 to 5%, Pt: 0.01 to 5% and Ag: 0.01 to 5%. This steel, containing the element(s) belonging to the first group, is a steel that has further excellence in high temperature strength. The grounds for selecting the content ranges of these elements will be described below.

Co: 0.05 to 5%

Since Co (Cobalt) is an element, which stabilizes austenite, likewise Ni, and also contributes to the enhancement of creep strength, it may be contained in the steel of the present invention. However, if the Co content is less than 0.05%, the effects are not exerted, and if the Co content exceeds 5%, the effects saturate and production cost increases. Thus the Co content is preferably 0.05 to 5%.

Mo: 0.05 to 5%, W: 0.05 to 10%

Since Mo (Molybdenum) and W (Tungsten) are effective elements for enhancing high temperature strength and creep strength, they may be contained in the steel of the present invention. When their contents are 0.05% or more, the above-mentioned effects are significant. However, if Mo content exceeds 5%, or if W content exceeds 10%, the effect of the enhancing strength saturates and structure stability and hot workability are deteriorated. Accordingly, the upper limits of their contents are 5% in Mo only, and 10% in W only, and if Mo and W are added together, it is desirable that the contents of these elements satisfy the following formula (3).

$$Mo + (W/2) \leqq 5 \quad (3)$$

Ti: 0.002 to 0.2%

Since Ti (Titanium) is an alloying element, which forms carbonitride that contributes to enhancing high temperature strength, it may be contained in the steel of the present invention. The effects become significant when the Ti content is 0.002% or more. However, if the Ti content is excessive, mechanical properties may be decreased due to unsolved nitride, and high temperature strength may be reduced due to decrease of fine nitride. Thus the Ti content is desirably 0.002 to 0.2%.

B: 0.0005 to 0.05%

B (Boron) is contained in carbonitride and also exists on grain boundaries as free B. Since B promotes fine precipitation of carbonitride during the use of the steel at high temperatures and suppresses grain boundary slip through the strengthening of grain boundaries, it improves high temperature strength and creep strength. These effects are remarkable when B content is 0.0005% or more. However, if the B content exceeds 0.05%, weldability deteriorates. Thus the B content is preferably 0.0005 to 0.05%, and a more preferable range of the B content is 0.001 to 0.01%. The most preferable range of the B content is 0.001 to 0.005%.

Zr: 0.0005 to 0.2%

Zr (Zirconium) is an alloying element, which effects the contribution to grain boundary strengthening in order to enhance high temperature and creep strength, and fixing S to improve hot workability. These effects become remarkable if the Zr content is 0.0005% or more. However, if the Zr content exceeds 0.2%, the mechanical properties such as ductility and toughness are deteriorated. Thus, a preferable range of Zr content is 0.0005 to 0.2%, and more preferable range is 0.01 to 0.1%. The most preferable range is 0.01 to 0.05%.

Hf: 0.0005 to 1%

Hf (Hafnium) is an element, which contributes mainly to grain boundary strengthening to enhance creep strength. This effect is remarkable when the Hf content is 0.005% or more. However, if the Hf content exceeds 1%, workability and weldability of the steel are impaired. Thus the Hf content is preferably 0.005 to 1%. A more preferable range is 0.01 to 0.8%, and the most preferable range is 0.02 to 0.5%.

Ta: 0.01 to 8%

Ta (Tantalum) forms carbonitride, and also is a solid-solution strengthening element. It enhances high temperature strength and creep strength, and this effect is remarkable if the Ta content is 0.01% or more. However, if the Hf content exceeds 8%, workability and mechanical properties of the steel are impaired, thus the Ta content is preferably 0.01 to 8%. A more preferable range of the Ta content is 0.1 to 7%, and the most preferable range is 0.5 to 6%.

Re: 0.01 to 8%

Re (Rhenium) enhances high temperature strength and creep strength mainly as a solid-solution strengthening element. This effect is remarkable if its content is 0.01% or more. However, if the Re content exceeds 8%, the workability and mechanical properties of the steel are impaired. Thus the Re content is preferably 0.01 to 8%. A more preferable range is 0.1 to 7%, and the most preferable range is 0.5 to 6%.

Ir, Pd, Pt, Ag: 0.01 to 5%

Ir, Pd, Pt and Ag dissolve in the austenite matrix of the steel to contribute to solid-solution strengthening, and change the lattice constant of the austenite matrix to enhance the long time stability of the Cu-phase, which coherently precipitates with the matrix of the steel. Further, a part of these elements forms fine intermetallic compounds in accordance with its additional amount and enhances high temperature strength and creep strength. These effects are remarkable if their contents are 0.01% or more. However, if the contents exceed 5%, the workability and mechanical properties of the steel are impaired. Thus their contents are preferably 0.01 to 5%. More preferable ranges of their contents are 0.05 to 4%, and the most preferable ranges are 0.1 to 3%.

Another austenitic stainless steel of the present invention contains, in the place of a part of Fe of the above-mentioned chemical composition, at least one element selected from the second group, consisting of Mg: 0.0005 to 0.05%, Ca: 0.0005 to 0.05%, Y: 0.0005 to 0.5%, La: 0.0005 to 0.5%, Ce: 0.0005 to 0.5%, Nd: 0.0005 to 0.5% and Sc: 0.0005 to 0.5%. This steel, containing the second element group element(s), is more excellent in hot workability. The grounds for restricting content ranges of these elements will be described below.

Mg: 0.0005 to 0.05%, Ca: 0.0005 to 0.05%

Mg (Magnesium) and Ca (Calcium) fix S, which hinders hot workability, as sulfide, so that they are effective in improving the hot workability. The above-mentioned effects are remarkable if the content is 0.0005% or more respectively. However, if the content exceeds 0.05%, the steel quality is impaired and hot workability and ductility decrease. Thus in the case where Mg and/or Ca are added, the content of each 0.0005 to 0.05% is preferable, and a more preferable range is 0.001 to 0.02%. The most preferable range is 0.001 to 0.01%.

Y, La, Ce, Nd, Sc: 0.0005 to 0.5%

All of Y, La, Ce, Nd and Sc are elements that fix S as a sulfide and improve hot workability. They also improve the adhesion of the $Cr_2O_3$ protective film on the steel surface, and particularly improve the oxidation resistance when the steel suffers repeated oxidation. Further, since these elements contribute to grain boundary strengthening, they enhance creep rupture strength and creep rupture ductility. When the content is 0.0005% or more respectively, the above-mentioned effects become remarkable. However, if the content exceeds 0.5%, a large amount of inclusions such as oxide are produced and workability and weldability are impaired. Accordingly, the content of 0.0005 to 0.05% is preferable, and a more referable range is 0.001 to 0.03%. The most preferable range is 0.002 to 0.15%.

The steels of the present invention, in which the above-mentioned chemical compositions are specified, can be widely applied to use where high temperature strength and corrosion resistance are needed. These products may be steel tube, steel plate, steel bar, forged steel products and the like.

2. Precipitates in the Steel of the Present Invention

In the steel of the present invention, having the above mentioned chemical composition and prepared under proper production conditions, complex nitiride with Cr, (Nb,V)CrN, and carbonitride, V(C,N), precipitate during use of the steel at high temperatures. The V(C,N) precipitates on grain boundaries and improve creep rupture strength, creep rupture ductility and the toughness of the steel according to the present invention, after being used at high temperatures of 800° C. or higher for a long period. Since these effects become significant at a precipitation amount of complex nitiride with Cr, (Nb,V)CrN, of $4/\mu m^2$ or more by the surface density and at a precipitation amount of carbonitride, V(C,N), of $8/\mu m^2$ or more by the surface density, it is preferable that they precipitate in these ranges during use of the steel at high temperatures. The complex nitiride, (Nb,V)CrN with Cr, precipitates mainly in polygonal or bead-like shape, and the V(C,N) carbonitride precipitates in spherical or disc-like shape. Particularly, in the case of the V(C, N) carbonitride, when the size is too large, the fixing force of the dislocation decreases. Accordingly the diameter of the precipitates of V(C,N) carbonitride is preferably 50 nm or less.

The (Nb,V)CrN is a kind of complex nitiride with Cr called as a "Z-phase", and its crystal structure is tetragonal. (Nb,V), Cr and N exist at a ratio of 1:1:1 in a unit cell of the (Nb,V)CrN complex nitiride with Cr. Further, the V(C,N) carbonitride is formed as the NaCl-type cubic carbide (VC) or the cubic nitride (VN), or a cubic carbonitride in which a part of the C atoms and the N atoms are mutually substituted. These carbides and nitrides form a face-centered cubic lattice in which metal atoms are densely stacked and have a crystal structure in which the octahedral sites are occupied by a C atom or a N atom.

The amount of these precipitates can be measured by use of a transmission electron microscope of a magnification of 10,000 or more while observing the structure of the steel. The measurement may be made by countering the respective precipitates separated by an electron beam diffraction pattern. The observation is desirably carried out in five fields.

3. Manufacturing Method of the Steel according to the Present Invention

The following method is recommendable for manufacturing the steel according to the present invention.

Billets are prepared by casting or by "casting and forging" or "casting and rolling" of the steel having the above-mentioned chemical composition. The billets are hot-worked in, for example, a hot extrusion or a hot rolling process. It is desirable that the heating temperature before hot working is 1160° C. to 1250° C. The finishing temperature of the hot working is desirably not lower than 1150° C. It is preferable to cool the hot worked products at a large cooling rate of 0.25° C./sec or more, to at least a temperature of not higher than 500° C., in order to suppress the precipitation of coarse carbonitrides after working.

After the hot working, a final heat treatment may be carried out. However, cold working may be added, if necessary, after the final heat treatment. Carbonitrides must be dissolved by heat treatment before the cold working. It is desirable to carry out the heat-treatment before the cold working at a temperature that is higher than the lowest temperature of the heating temperature before the hot working and the hot working finishing temperature. The cold working is preferably performed by applying strain of 10% or more, and two or more times cold workings may be subjected.

The heat treatment for finished products is carried out at a temperature in a range of 1170 to 1300° C. The temperature is preferably higher than the finishing temperature of the hot working or the above-mentioned heat treatment before the cold working, by 10° C. or more. The steel of the present invention is not necessarily a grain-refined steel from the viewpoint of corrosion resistance. However, if the steel should be grain refined, the final heat treatment should be carried out at a temperature lower than the temperature of the hot working finishing or the temperature of the above-mentioned heat treatment before the cold working, by 10° C. or more. The products are preferably cooled at a cooling rate of 0.25° C./sec or more in order to suppress the precipitation of coarse carbonitrides.

If the creep rupture ductility is particularly important, the heat treatment temperature and the cooling rate may be controlled so that an amount of unsolved Nb in the finally heat-treated product is in a range of "0.04×Cu (mass %)" to "0.085×Cu (mass %)" by use of a steel whose chemical composition is controlled from 0.05 to 0.2 for the content ratio of Nb to Cu, i.e., "Nb/Cu".

Although only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention.

EXAMPLE

Steels, having chemical compositions shown in Tables. 1 and 2, were melted by use of a high-frequency vacuum melting furnace to obtain ingots of 50 kg with the outer diameter of 180 mm. The steels of Nos. 1 to 38 are steels of the present invention and steels of A to O are comparative steels.

TABLE 1

| | | Chemical Composition (mass %, the balance: Fe and Incidental Impurities) | | | | | | | | | | | | | | | | |
|---|---|---|---|---|---|---|---|---|---|---|---|---|---|---|---|---|---|---|
| | Steel No. | C | Si | Mn | P | S | Cr | Ni | Cu | Nb | V | Al | N | O | the others | Upper limit of P | Upper limit of Al | Upper limit of O |
| Steel of This Invention | 1 | 0.059 | 0.39 | 1.17 | 0.015 | 0.002 | 24.80 | 24.80 | 3.30 | 0.42 | 0.07 | 0.008 | 0.21 | 0.003 | | 0.028 | 0.084 | 0.005 |
| | 2 | 0.060 | 0.41 | 1.23 | 0.026 | 0.002 | 25.20 | 24.70 | 3.31 | 0.44 | 0.06 | 0.009 | 0.22 | 0.002 | | 0.027 | 0.088 | 0.005 |
| | 3 | 0.089 | 0.39 | 1.22 | 0.017 | 0.002 | 24.80 | 29.90 | 2.95 | 0.45 | 0.11 | 0.015 | 0.20 | 0.002 | | 0.031 | 0.080 | 0.006 |
| | 4 | 0.093 | 0.38 | 1.27 | 0.016 | 0.002 | 24.70 | 29.70 | 2.92 | 0.41 | 0.12 | 0.017 | 0.23 | 0.005 | | 0.031 | 0.092 | 0.006 |
| | 5 | 0.126 | 0.37 | 1.27 | 0.017 | 0.002 | 24.20 | 38.60 | 3.03 | 0.34 | 0.25 | 0.013 | 0.10 | 0.003 | | 0.030 | 0.040 | 0.006 |
| | 6 | 0.130 | 0.39 | 1.20 | 0.018 | 0.003 | 25.10 | 38.80 | 2.98 | 0.33 | 0.27 | 0.033 | 0.09 | 0.004 | | 0.031 | 0.036 | 0.006 |
| | 7 | 0.066 | 0.39 | 0.41 | 0.016 | 0.003 | 23.30 | 19.60 | 2.82 | 0.44 | 0.04 | 0.011 | 0.19 | 0.005 | | 0.032 | 0.076 | 0.006 |
| | 8 | 0.074 | 0.42 | 0.42 | 0.013 | 0.003 | 23.60 | 19.90 | 2.79 | 0.45 | 0.82 | 0.010 | 0.20 | 0.005 | | 0.033 | 0.080 | 0.006 |
| | 9 | 0.070 | 0.46 | 0.38 | 0.014 | 0.0005 | 23.20 | 20.10 | 2.96 | 0.44 | 0.23 | 0.013 | 0.20 | 0.005 | 0.0041B, 0.0035Ca | 0.031 | 0.080 | 0.006 |
| | 10 | 0.061 | 0.47 | 1.19 | 0.008 | 0.002 | 20.30 | 18.40 | 2.14 | 0.47 | 0.44 | 0.015 | 0.17 | 0.005 | 0.31Mo, 1.63W | 0.042 | 0.068 | 0.008 |
| | 11 | 0.056 | 0.44 | 1.27 | 0.007 | 0.003 | 21.20 | 15.80 | 3.41 | 0.35 | 0.46 | 0.009 | 0.26 | 0.003 | 0.67Mo, 1.33W | 0.027 | 0.106 | 0.005 |
| | 12 | 0.058 | 0.41 | 1.22 | 0.018 | 0.002 | 24.60 | 20.50 | 2.82 | 0.71 | 0.15 | 0.015 | 0.06 | 0.004 | | 0.032 | 0.024 | 0.006 |
| | 13 | 0.058 | 0.42 | 1.30 | 0.017 | 0.002 | 27.40 | 25.80 | 3.70 | 0.46 | 0.17 | 0.018 | 0.22 | 0.003 | 3.56Co | 0.025 | 0.088 | 0.005 |
| | 14 | 0.056 | 0.41 | 1.22 | 0.017 | 0.003 | 25.20 | 29.90 | 3.76 | 0.48 | 0.27 | 0.015 | 0.21 | 0.003 | 2.88Mo | 0.024 | 0.084 | 0.004 |

TABLE 1-continued

| Steel No. | Chemical Composition (mass %, the balance: Fe and Incidental Impurities) | | | | | | | | | | | | | | | | |
|---|---|---|---|---|---|---|---|---|---|---|---|---|---|---|---|---|---|
| | C | Si | Mn | P | S | Cr | Ni | Cu | Nb | V | Al | N | O | the others | Upper limit of P | Upper limit of Al | Upper limit of O |
| 15 | 0.059 | 0.43 | 1.28 | 0.016 | 0.002 | 24.40 | 35.30 | 3.80 | 0.44 | 0.22 | 0.025 | 0.18 | 0.002 | 3.25W | 0.024 | 0.072 | 0.004 |
| 16 | 0.070 | 0.41 | 1.18 | 0.015 | 0.003 | 24.90 | 24.40 | 3.73 | 0.44 | 0.26 | 0.017 | 0.23 | 0.002 | 0.05Ti | 0.024 | 0.093 | 0.004 |
| 17 | 0.061 | 0.44 | 1.18 | 0.017 | 0.002 | 24.90 | 25.90 | 3.84 | 0.45 | 0.16 | 0.014 | 0.24 | 0.003 | 0.0049B | 0.024 | 0.096 | 0.004 |
| 18 | 0.057 | 0.44 | 1.17 | 0.016 | 0.003 | 24.60 | 20.00 | 3.75 | 0.47 | 0.23 | 0.018 | 0.26 | 0.003 | 0.03Zr | 0.024 | 0.104 | 0.004 |
| 19 | 0.069 | 0.39 | 1.26 | 0.018 | 0.003 | 25.30 | 23.70 | 3.90 | 0.43 | 0.41 | 0.017 | 0.24 | 0.003 | 0.0038Mg | 0.023 | 0.094 | 0.004 |
| 20 | 0.057 | 0.37 | 1.29 | 0.017 | 0.003 | 25.30 | 19.60 | 3.71 | 0.42 | 0.20 | 0.013 | 0.25 | 0.003 | 0.0029Ca | 0.025 | 0.102 | 0.004 |
| 21 | 0.060 | 0.41 | 1.24 | 0.016 | 0.002 | 25.00 | 19.80 | 3.67 | 0.47 | 1.25 | 0.014 | 0.27 | 0.004 | 0.04Y | 0.025 | 0.106 | 0.005 |
| 22 | 0.059 | 0.43 | 1.19 | 0.017 | 0.002 | 25.00 | 20.10 | 3.66 | 0.46 | 0.26 | 0.019 | 0.26 | 0.002 | 0.06La | 0.025 | 0.106 | 0.005 |
| 23 | 0.057 | 0.41 | 2.16 | 0.017 | 0.002 | 24.90 | 19.60 | 3.63 | 0.42 | 0.27 | 0.014 | 0.24 | 0.003 | 0.02Ce | 0.025 | 0.096 | 0.005 |
| 24 | 0.055 | 0.38 | 1.25 | 0.016 | 0.002 | 24.80 | 20.40 | 3.73 | 0.45 | 0.30 | 0.012 | 0.27 | 0.002 | 0.04Nd | 0.024 | 0.108 | 0.004 |
| 25 | 0.031 | 0.50 | 1.19 | 0.015 | 0.002 | 25.50 | 21.80 | 3.69 | 0.42 | 0.31 | 0.014 | 0.26 | 0.003 | 0.08Sc | 0.025 | 0.104 | 0.005 |
| 26 | 0.056 | 0.42 | 1.20 | 0.016 | 0.002 | 25.20 | 20.10 | 3.74 | 0.44 | 0.29 | 0.014 | 0.26 | 0.002 | 0.21Hf | 0.024 | 0.105 | 0.004 |

Note:
"Al" means "sol.Al".
Upper limits of P, Al and O are obtained from formulas (1), (2) and (3), respectively.

TABLE 2

| | Steel No. | Chemical Composition (mass %, the balance: Fe and Incidental Impurities) | | | | | | | | | | |
|---|---|---|---|---|---|---|---|---|---|---|---|---|
| | | C | Si | Mn | P | S | Cr | Ni | Cu | Nb | V | Al |
| Steel of This Invention | 28 | 0.057 | 0.39 | 1.21 | 0.016 | 0.002 | 25.50 | 48.6 | 3.83 | 0.48 | 0.16 | 0.015 |
| | 29 | 0.056 | 0.42 | 1.26 | 0.015 | 0.002 | 25.20 | 44.9 | 3.84 | 0.47 | 0.09 | 0.015 |
| | 30 | 0.059 | 0.45 | 1.18 | 0.015 | 0.003 | 24.90 | 52.5 | 3.67 | 0.45 | 0.26 | 0.018 |
| | 31 | 0.062 | 0.41 | 1.05 | 0.016 | 0.002 | 24.80 | 40.3 | 3.66 | 0.38 | 0.21 | 0.016 |
| | 32 | 0.060 | 0.40 | 1.14 | 0.014 | 0.002 | 25.30 | 48.5 | 3.58 | 0.44 | 0.23 | 0.018 |
| | 33 | 0.059 | 0.42 | 1.17 | 0.014 | 0.002 | 25.10 | 29.8 | 3.73 | 0.44 | 0.18 | 0.016 |
| | 34 | 0.060 | 0.40 | 1.22 | 0.014 | 0.003 | 25.50 | 29.7 | 3.79 | 0.45 | 0.20 | 0.017 |
| | 35 | 0.059 | 0.36 | 1.13 | 0.015 | 0.003 | 25.50 | 25.0 | 3.78 | 0.46 | 0.18 | 0.013 |
| | 36 | 0.056 | 0.37 | 1.15 | 0.015 | 0.002 | 25.20 | 34.5 | 3.84 | 0.42 | 0.27 | 0.012 |
| | 37 | 0.061 | 0.40 | 1.21 | 0.013 | 0.002 | 24.70 | 31.7 | 3.90 | 0.45 | 0.26 | 0.016 |
| | 38 | 0.055 | — | 0.85 | 0.014 | 0.001 | 23.80 | 20.4 | 2.88 | 0.20 | 0.51 | 0.013 |
| Comparative Examples | A | 0.062 | 0.42 | 1.13 | 0.030* | 0.002 | 24.90 | 25.0 | 3.24 | 0.43 | 0.07 | 0.012 |
| | B | 0.060 | 0.41 | 1.20 | 0.036* | 0.002 | 24.80 | 24.9 | 3.29 | 0.43 | 0.08 | 0.010 |
| | C | 0.061 | 0.38 | 1.21 | 0.023* | 0.002 | 25.20 | 25.0 | 4.66 | 0.43 | 0.07 | 0.008 |
| | D | 0.121 | 0.41 | 1.20 | 0.015 | 0.003 | 25.10 | 38.7 | 3.02 | 0.36 | 0.30 | 0.038* |
| | E | 0.122 | 0.37 | 1.21 | 0.016 | 0.002 | 25.20 | 38.5 | 3.10 | 0.31 | 0.27 | 0.055* |
| | F | 0.129 | 0.38 | 1.20 | 0.018 | 0.002 | 25.10 | 38.6 | 3.05 | 0.35 | 0.28 | 0.031* |
| | G | 0.069 | 0.38 | 0.40 | 0.014 | 0.003 | 22.50 | 20.0 | 3.01 | 0.44 | 0.01* | 0.011 |
| | H | 0.072 | 0.41 | 0.41 | 0.014 | 0.003 | 23.20 | 19.6 | 2.94 | 0.45 | 0.0005* | 0.009 |
| | I | 0.070 | 0.40 | 0.43 | 0.016 | 0.0004 | 22.80 | 19.8 | 3.02 | 0.46 | 0.0004* | 0.012 |
| | J | 0.059 | 0.41 | 1.21 | 0.007 | 0.002 | 20.50 | 18.5 | 1.81* | 0.46 | 0.46 | 0.012 |
| | K | 0.041* | 0.46 | 1.29 | 0.005 | 0.002 | 20.80 | 16.0 | 3.38 | 0.37 | 0.47 | 0.011 |
| | L | 0.060 | 0.39 | 1.20 | 0.017 | 0.001 | 24.90 | 20.8 | 2.79 | 0.75 | 0.16 | 0.014 |

| | Steel No. | Chemical Composition (mass %, the balance: Fe and Incidental Impurities) | | | | | |
|---|---|---|---|---|---|---|---|
| | | N | O | the others | Upper limit of P | Upper limit of Al | Upper limit of O |
| Steel of This Invention | 28 | 0.10 | 0.002 | 3.3Re | 0.024 | 0.040 | 0.004 |
| | 29 | 0.13 | 0.002 | 1.49Ir | 0.024 | 0.052 | 0.004 |
| | 30 | 0.08 | 0.002 | 1.13Pd | 0.025 | 0.032 | 0.005 |
| | 31 | 0.10 | 0.002 | 0.52Pt | 0.025 | 0.040 | 0.005 |
| | 32 | 0.07 | 0.002 | 2.10Ag | 0.025 | 0.028 | 0.005 |
| | 33 | 0.21 | 0.002 | 0.0039B, 1.38W | 0.024 | 0.084 | 0.004 |
| | 34 | 0.20 | 0.003 | 0.02Zr, 0.98W, 0.0035Ca | 0.024 | 0.080 | 0.004 |
| | 35 | 0.23 | 0.002 | 1.43Co, 0.15Nd | 0.024 | 0.092 | 0.004 |
| | 36 | 0.19 | 0.003 | 4.50W, 0.08Y | 0.024 | 0.076 | 0.004 |
| | 37 | 0.21 | 0.002 | 3.17Mo, 0.76Hf | 0.023 | 0.084 | 0.004 |
| | 38 | 0.18 | 0.002 | | 0.032 | 0.072 | 0.006 |
| Comparative Examples | A | 0.22 | 0.003 | | 0.028 | 0.088 | 0.005 |
| | B | 0.20 | 0.003 | | 0.028 | 0.080 | 0.005 |
| | C | 0.21 | 0.002 | | 0.020 | 0.084 | 0.004 |
| | D | 0.09 | 0.003 | | 0.030 | 0.036 | 0.006 |
| | E | 0.10 | 0.004 | | 0.029 | 0.040 | 0.005 |
| | F | 0.06 | 0.003 | | 0.030 | 0.024 | 0.005 |
| | G | 0.21 | 0.003 | | 0.030 | 0.084 | 0.006 |

TABLE 2-continued

| | | | | | | |
|---|---|---|---|---|---|---|
| H | 0.19 | 0.004 | | 0.031 | 0.076 | 0.006 |
| I | 0.21 | 0.005 | 0.0043B, 0.0040Ca | 0.030 | 0.084 | 0.006 |
| J | 0.18 | 0.004 | 0.35Mo, 1.70W | 0.050 | 0.072 | 0.009 |
| K | 0.25 | 0.003 | 0.70Mo, 1.39W | 0.027 | 0.100 | 0.005 |
| L | 0.04* | 0.004 | | 0.033 | 0.016 | 0.006 |

Note:
"Al" means "sol.Al".
Upper limits of P, Al and O are obtained from formulas (1), (2) and (3), respectively.
"*" shows out of the range defined by the present invention.

Test pieces were prepared from the obtained ingots by the following methods. As test pieces for evaluating high temperature ductility, the above-mentioned ingots were hot-forged into steel plates, each having a thickness of 40 mm, and round bar tensile test pieces (diameter: 10 mm, length: 130 mm) were prepared by machining.

Further, as test pieces for creep rupture tests, the above-mentioned ingots were hot-forged into steel plates having a thickness of 15 mm. After softening heat treatment, the steel plates were cold-rolled to 10 mm thickness and were maintained at 1230° C. for 15 minutes. Then the plates were water-cooled and the round bar test pieces (diameter: 6 mm, gauge length: 30 mm) were prepared by machining the plates.

The water-cooled plates of the steels of Nos. 7 and 8 of the present invention and comparative steels J and K were aged at 800° C. for 3,000 hours, and V notch test pieces (width: 5 mm, height: 10 mm, length: 55 mm, notch: 2 mm) were prepared for evaluating their toughness. Two test pieces were prepared for each steel.

Regarding the ductility at high temperature, the above-mentioned round bar tensile test pieces (diameter: 10 mm, length: 130 mm) were used. Each of the test pieces was heated at 1220° C. for three minutes. Thereafter, a high-speed tensile test of a strain rate of 5/sec was performed and a reduction of area was obtained from the rupture surface. It is known that there are no serious problems in hot working such as hot extrusion when the reduction of area is 60% or more at the above-mentioned temperature. Accordingly, the reduction area of 60% or more was set for a criterion of a good hot workability.

Regarding the creep rupture strength, the above-mentioned round bar test pieces (diameter: 6 mm, gauge length: 30 mm) were used. With respect to each of the test pieces, a creep rupture test was performed in the atmospheres of 750° C. and 800° C. and a rupture strength at 750° C. and for $10^5$ h was obtained by the Larson-Miller parameter method. Further, regarding the creep rupture elongation, the above-mentioned round bar test pieces (diameter: 6 mm, gauge length: 30 mm) were used. With respect to each of the test pieces a creep rupture test, which applies a load of 130 MPa at 750° C. was performed to measure a rupture elongation.

Regarding the toughness after aging, V notch test pieces (width: 5 mm, height: 10 mm, length: 55 mm, notch: 2 mm) made of materials aged at 800° C. for 3,000 hours were used. Each test piece was cooled to 0° C. for the Charpy impact test and the average of test results of these two test pieces was obtained as an impact value.

The amounts of precipitates of the steels, according to the present invention, were measured by sampling test pieces from parallel portions of the ruptured specimens of a creep test, which was performed under 130 MPa at 750° C., observing structures by magnification of 10,000, using a transmission electron microscope, and countering the number of the respective precipitates separated by an electron beam diffraction pattern. The observation of the structure was performed in five fields and the average was determined as the precipitation amount.

These results are shown in tables 3 and 4.

TABLE 3

| | Steel No. | Amount of Precipitates (Nb, V) CrN (Number/$\mu m^2$) | Amount of Precipitates V (C, N) (Number/$\mu m^2$) | Reduction of Area (%) | Creep Rupture Strength (MPa) | Creep Rupture Elongation (%) | Charpy Impact Value (J/$cm^2$) |
|---|---|---|---|---|---|---|---|
| Steel of This Invention | 1 | 9 | 21 | 88.1 | 71.2 | 31.9 | — |
| | 2 | 10 | 24 | 70.4 | 71.0 | 27.1 | — |
| | 3 | 13 | 48 | 90.1 | 73.1 | 33.6 | — |
| | 4 | 12 | 51 | 78.0 | 73.6 | 31.1 | — |
| | 5 | 6 | 25 | 82.5 | 75.1 | 30.9 | — |
| | 6 | 6 | 28 | 88.3 | 75.8 | 32.2 | — |
| | 7 | 9 | 22 | 85.2 | 70.2 | 34.0 | 88 |
| | 8 | 15 | 162 | 83.5 | 78.5 | 29.1 | 105 |
| | 9 | 9 | 71 | 95.1 | 79.5 | 31.9 | — |
| | 10 | 12 | 95 | 89.8 | 80.5 | 32.2 | — |
| | 11 | 14 | 108 | 93.2 | 80.2 | 35.3 | — |
| | 12 | 9 | 42 | 72.0 | 70.9 | 27.3 | — |
| | 13 | 12 | 56 | 84.9 | 80.4 | 32.9 | — |
| | 14 | 12 | 74 | 81.6 | 80.5 | 31.0 | — |
| | 15 | 10 | 48 | 79.5 | 81.1 | 26.8 | — |
| | 16 | 13 | 76 | 83.7 | 80.0 | 30.4 | — |
| | 17 | 12 | 60 | 80.7 | 79.8 | 28.4 | — |

TABLE 3-continued

| Steel No. | Amount of Precipitates (Nb, V) CrN (Number/$\mu m^2$) | Amount of Precipitates V (C, N) (Number/$\mu m^2$) | Reduction of Area (%) | Creep Rupture Strength (MPa) | Creep Rupture Elongation (%) | Charpy Impact Value (J/cm$^2$) |
|---|---|---|---|---|---|---|
| 18 | 15 | 82 | 79.2 | 79.7 | 31.2 | — |
| 19 | 13 | 102 | 92.1 | 75.1 | 24.7 | — |
| 20 | 13 | 66 | 93.0 | 75.4 | 30.2 | — |
| 21 | 21 | 268 | 90.8 | 78.8 | 27.7 | — |
| 22 | 14 | 87 | 95.2 | 74.6 | 29.5 | — |
| 23 | 13 | 74 | 90.1 | 74.9 | 31.8 | — |
| 24 | 14 | 94 | 93.6 | 75.0 | 33.8 | — |
| 25 | 14 | 80 | 92.6 | 75.1 | 29.1 | — |
| 26 | 12 | 88 | 88.5 | 79.8 | 30.7 | — |
| 27 | 9 | 44 | 78.1 | 80.2 | 26.9 | |

TABLE 4

| | Steel No. | Amount of Precipitates (Nb, V) CrN (Number/$\mu m^2$) | Amount of Precipitates V (C, N) (Number/$\mu m^2$) | Reduction of Area (%) | Creep Rupture Strength (MPa) | Creep Rupture Elongation (%) | Charpy Impact Value (J/cm$^2$) |
|---|---|---|---|---|---|---|---|
| Steel of This Invention | 28 | 7 | 17 | 75.5 | 80.5 | 27.0 | — |
| | 29 | 8 | 12 | 76.4 | 81.2 | 30.3 | — |
| | 30 | 7 | 23 | 78.4 | 81.4 | 27.8 | — |
| | 31 | 8 | 14 | 77.2 | 80.5 | 28.6 | — |
| | 32 | 8 | 13 | 76.5 | 80.8 | 29.0 | — |
| | 33 | 11 | 51 | 84.1 | 80.1 | 31.7 | — |
| | 34 | 11 | 53 | 92.0 | 80.4 | 31.7 | — |
| | 35 | 12 | 61 | 93.5 | 80.2 | 29.6 | — |
| | 36 | 10 | 56 | 92.6 | 80.9 | 28.1 | — |
| | 37 | 12 | 68 | 84.9 | 80.4 | 31.3 | — |
| | 38 | 9 | 54 | 81.6 | 72.5 | 30.0 | — |
| Comparative Examples | A | 11 | 34 | 55.6 | 71.4 | 9.0 | — |
| | B | 10 | 28 | 32.3 | 70.9 | 5.5 | — |
| | C | 10 | 29 | 51.3 | 72.5 | 7.0 | — |
| | D | 7 | 35 | 88.7 | 68.4 | 32.8 | — |
| | E | 7 | 25 | 90.9 | 66.2 | 32.0 | — |
| | F | 6 | 22 | 91.2 | 67.5 | 31.9 | — |
| | G | 4 | 3 | 86.6 | 63.1 | 30.4 | 51 |
| | H | 3 | 2 | 84.8 | 61.7 | 31.4 | 40 |
| | I | 3 | 2 | 94.2 | 62.8 | 35.5 | — |
| | J | 12 | 85 | 91.0 | 68.0 | 32.3 | — |
| | K | 10 | 51 | 91.1 | 69.8 | 36.0 | — |
| | L | 3 | 5 | 75.7 | 66.8 | 25.9 | — |

As shown in Tables 3 and 4, comparative steels A to C are examples, in which P contents exceed the range specified by the formula (1). The chemical compositions, except for P, of the comparative steels A and B are the same as those of the steels 1 and 2 of the present invention, and the P content of the comparative steel C is substantially the same as that of the steel 2 of the present invention. However, their values of reduction of area and creep rupture elongation are low. Therefore the creep rupture ductility and hot workability of these comparative steels are insufficient.

All of the comparative steels D to F are examples that do not satisfy the range specified by the formula (2) in sol.Al contents. Although the chemical compositions, except for sol.Al, are substantially the same as those of the steels 5 and 6 of the present invention, their creep rupture strengths are low.

V contents of the comparative steels G, H and I are in a range lower than the range specified by the present invention. Although the chemical compositions, except for V, are substantially the same as those of the steels 7 and 8 of the present invention, the creep rupture strengths were low level. The Charpy impact values of the comparative examples G and H are smaller than those of examples 7 and 8 of the present invention. When no V is added, the toughness after aging is remarkably reduced. The comparative steel I is a steel within the scope of the invention proposed in the afore-mentioned Publication of unexamined Patent Application No.2001-49400.

In the comparative steels J, K and L, any one of the Cu content, C content and N content is less than the range specified by the present invention. However the other chemical compositions of these steels are substantially the same as those of the steels 10, 11 and 12 of the present invention, respectively. In these comparative examples, creep rupture strengths are inferior to those of the steels of the present invention.

On the other hand, in the steels 1 to 8, and steels 12 and 38, all values of the creep rupture strength, creep rupture ductility and hot workability are good. The steels 9 to 11 and steels 13 to 37 of the present invention, which include at least one element of the first group and/or the second group, are further improved in the hot workability and creep rupture strength.

Industrial Applicability

According to the present invention, it can be possible that hot workability, strength and toughness, during long periods of use at a high temperature, are remarkably improved in the austenitic stainless steel containing Cu, Nb and N. The austenitic stainless steel of the present invention, as a heat resistant and pressure resistant member under a high temperature of 650° C. to 700° C. or higher, contributes to making a plant highly efficient. Additionally, since the steel can be manufactured at lower costs, it can be used in various fields.

What is claimed is:

1. An austenitic stainless steel characterized by consisting of, by mass %, C: more than 0.05% to 0.15%, Si: 2% or less, Mn: 0.1 to 3%, P: 0.04% or less, S: 0.01% or less, Cr: more than 20% to less than 28%, Ni: more than 15% to 55%, Cu: more than 2% to 6%, Nb: 0.1 to 0.8%, V: 0.02 to 1.5%, sol.Al: 0.001 to 0.1%, N: more than 0.05% to 0.3% and O (Oxygen): 0.006% or less, and the balance Fe and impurities, further characterized by satisfying the following formulas (1) and (2):

$$P \leqq 1/(11 \times Cu) \quad (1)$$

$$sol.Al \leqq 0.4 \times N \quad (2)$$

wherein each element symbol in the formulas (1) and (2) represents the content (mass %) of each element.

2. An austenitic stainless steel characterized by consisting of, by mass %, C: more than 0.05% to 0.15%, Si: 2% or less, Mn: 0.1 to 3%, P: 0.04% or less, S: 0.01% or less, Cr: more than 20% to less than 28%, Ni: more than 15% to 55%, Cu: more than 2% to 6%, Nb: 0.1 to 0.8%, V: 0.02 to 1.5%, sol.Al: 0.001 to 0.1%, N: more than 0.05% to 0.3% and O (Oxygen): 0.006% or less, and at least one element selected from the group consisting of Co: 0.05 to 5%, Mo: 0.05 to 5%, W: 0.05 to 10%, Ti: 0.002 to 0.2%, B: 0.0005 to 0.05%, Zr: 0.0005 to 0.2%, Hf: 0.0005 to 1%, Ta: 0.01 to 8%, Re: 0.01 to 8%, Ir: 0.01 to 5%, Pd: 0.01 to 5%, Pt: 0.01 to 5% and Ag: 0.01 to 5%, and the balance Fe and impurities, further characterized by satisfying the following formulas (1) to (3):

$$P \leqq 1/(11 \times Cu) \quad (1)$$

$$sol.Al \leqq 0.4 \times N \quad (2)$$

$$Mo+(W/2) \leqq 5 \quad (3)$$

wherein each element symbol in the formulas (1) to (3) represents the content (mass %) of each element.

3. An austenitic stainless steel characterized by consisting of, by mass %, C: more than 0.05% to 0.15%, Si: 2% or less, Mn: 0.1 to 3%, P: 0.04% or less, S: 0.01% or less, Cr: more than 20% to less than 28%, Ni: more than 15% to 55%, Cu: more than 2% to 6%, Nb: 0.1 to 0.8%, V: 0.02 to 1.5%, sol.Al: 0.001 to 0.1%, N: more than 0.05% to 0.3% and O (Oxygen): 0.006% or less, and at least one element selected from the group consisting of Mg: 0.0005 to 0.05%, Ca: 0.0005 to 0.05%, Y: 0.0005 to 0.5%, La: 0.0005 to 0.5%, Ce: 0.0005 to 0.5%, Nd: 0.0005 to 0.5% and Sc: 0.0005 to 0.5%, and the balance Fe and impurities, further characterized by satisfying the following formulas (1) and (2)

$$P \leqq 1/(11 \times Cu) \quad (1)$$

$$sol.Al \leqq 0.4 \times N \quad (2)$$

wherein each element symbol in the formulas (1) and (2) represents the content (mass %) of each element.

4. An austenitic stainless steel characterized by consisting of, by mass %, C: more than 0.05% to 0.15%, Si: 2% or less, Mn: 0.1 to 3%, P: 0.04% or less, S: 0.01% or less, Cr: more than 20% to less than 28%, Ni: more than 15% to 55%, Cu: more than 2% to 6%, Nb:0.1 to 0.8%, V: 0.02 to 1.5%, sol.Al: 0.001 to 0.1%, N: more than 0.05% to 0.3% and O (Oxygen): 0.006% or less, and at least one element selected from the group consisting of Co: 0.05 to 5%, Mo: 0.05 to 5%, W: 0.05 to 10%, Ti: 0.002 to 0.2%, B: 0.0005 to 0.05%, Zr: 0.0005 to 0.2%, Hf: 0.0005 to 1%, Ta: 0.01 to 8%, Re: 0.01 to 8%, Ir: 0.001 to 5%, Pd: 0.01 to 5%, Pt: 0.01 to 5% and Ag: 0.01 to 5%, and further at least one element selected from the group consisting of Mg: 0.0005 to 0.05%, Ca: 0.0005 to 0.05%, Y: 0.0005 to 0.5%, La: 0.0005 to 0.5%, Ce: 0.0005 to 0.5%, Nd: 0.0005 to 0.5% and Sc: 0.0005 to 0.5%, and the balance Fe and impurities, further characterized by satisfying the following formulas (1) to (3)

$$P \leqq 1/(11 \times Cu) \quad (1)$$

$$sol.Al \leqq 0.4 \times N \quad (2)$$

$$Mo+(W/2) \leqq 5 \quad (3)$$

wherein each element symbol in the formulas (1) to (3) represents the content (mass %) of each element.

5. An austenitic stainless steel according to claim 1, further characterized by satisfying the following formula (4)

$$O \leqq 1/(60 \times Cu) \quad (4)$$

wherein each element symbol in the formula (4) represents the content (mass %) of each element.

6. An austenitic stainless steel according to claim 2, further characterized by satisfying the following formula (4)

$$O \leqq 1/(60 \times Cu) \quad (4)$$

wherein each element symbol in the formula (4) represents the content (mass %) of each element.

7. An austenitic stainless steel according to claim 3, further characterized by satisfying the following formula (4)

$$O \leqq 1/(60 \times Cu) \quad (4)$$

wherein each element symbol in the formula (4) represents the content (mass %) of each element.

8. An austenitic stainless steel according to claim 4, further characterized by satisfying the following formula (4)

$$O \leqq 1/(60 \times Cu) \quad (4)$$

wherein each element symbol in the formula (4) represents the content (mass %) of each element.

* * * * *